US005168689A

United States Patent [19]

Macelis

[11] Patent Number: 5,168,689

[45] Date of Patent: Dec. 8, 1992

[54] ENVELOPE STUFFING APPARATUS WITH ADJUSTABLE DECK FOR HANDLING DIFFERENT STYLED ENVELOPES

[75] Inventor: Anthony M. Macelis, Watertown, Conn.

[73] Assignee: Pitney Bowes Inc., Stamford, Conn.

[21] Appl. No.: 783,435

[22] Filed: Oct. 24, 1991

[51] Int. Cl.[5] ..... B65B 43/34; B65B 39/12

[52] U.S. Cl. ..... 53/569; 53/284.3; 53/381.5

[58] Field of Search ..... 53/569, 284.3, 381.7, 53/381.5, 387.1, 387.2, 460, 260

[56] References Cited

U.S. PATENT DOCUMENTS

| | | | |
|---|---|---|---|
| 3,319,395 | 5/1967 | Lundquist et al. | 53/284.3 |
| 4,205,506 | 6/1980 | Moens et al. | 53/569 |
| 4,888,938 | 12/1989 | Auerbach | 53/569 |
| 4,944,137 | 7/1990 | Krasuski et al. | 53/569 |

*Primary Examiner*—James F. Coan

*Attorney, Agent, or Firm*—Charles R. Malandra, Jr.; Melvin J. Scolnick

[57] ABSTRACT

In an envelope stuffing apparatus which has an enclosure inserting station and includes a deck at the inserting station, side guides coupled to the deck, structure for delivering an enclosure along the deck, structure for feeding an envelope to the inserting station, structure for opening the envelope, and structure for inserting an enclosure into the envelope and for removing the envelope from the inserting station, and wherein said opening structure includes structure for supporting the flap of the envelope above the deck, there is an improvement in the inserting structure for handling different style envelopes. The improvement comprises an adjustable section of the deck comprising a center deck plate adjustably mounted for being positioned adjacent to a specific throat opening of the envelope. The center deck plate is on a horizontal plane slightly higher than a plane of horizontal members of a pair of throat openers.

13 Claims, 3 Drawing Sheets

ENVELOPE STUFFING APPARATUS WITH ADJUSTABLE DECK FOR HANDLING DIFFERENT STYLED ENVELOPES

RELATED APPLICATION

U.S. patent application Ser. No. 07/608515, filed Nov. 2, 1990 refers to subject matter related to the subject matter of this application.

FIELD OF THE INVENTION

The present invention relates to an envelope stuffing apparatus, and more particularly as directed to a envelope stuffing apparatus on an inserter machine.

BACKGROUND OF THE INVENTION

Envelope stuffing machines, for example of the type shown in U.S. Pat. No. 2,736,999 issued Mar. 6, 1956 to F. J. Rouan, et al., U.S. Pat. No. 2,914,895 issued Dec. 1, 1959 to S. W. Martin, U.S. Pat. No. 4,077,181 issued Mar. 7, 1978 to L. K. Asher, et al., U.S. Pat. No. 4,169,341 issued Oct. 2, 1979 to F. T. Roetter, et al, all of which patents are assigned to the assignee of the present invention, generally include: structure for delivering an envelope, with its address panel oriented upwardly and its flap opened, to a registration gate at an enclosure inserting station; structure for timely opening the delivered envelope, including a plurality of fingers known in the art as stripper fingers, which are insertable into the throat of the envelope for opening the same; and structure for inserting an enclosure into the opened envelope. More particularly, the envelope opening structure of these devices includes a plate which acts as a ledge upon which the flap of the envelope is located when it is delivered to the inserting station. And, although none of the aforesaid patents show the same, the assignee of the present invention has for many years provided in its Model 3320 Table Top Inserter, one or more rigid finger members, known in the art as depressor fingers, which are fixedly attached to the framework of the Inserter and disposed in overhanging relationship with respect to the envelope's address panel, for depressing the body of the envelope's address panel downwardly against the resistance afforded by the envelope flap ledge, for partially opening the throat of the envelope to facilitate insertion of the stripper fingers into the envelope.

In U.S. Pat. No. 4,337,609 issued Jul. 6, 1982 to D. H. Foster, et al. and assigned to the assignee of the present invention, there is shown an envelope stuffing apparatus which includes a enclosure ram, a pair of outfeed push rollers and stripper fingers. The ram comprises a reciprocal ram plate having a depending portion which engages the enclosures. On the forward stroke of the ram plate, the plate carries therewith the enclosures into the throat of the opened envelope. As is well known in the art, the ram plate also moves the stuffed enveloped downstream into feed engagement with the outfeed rollers. Accordingly, the ram and outfeed rollers cooperate with each other for removing stuffed envelopes from the insert station.

The ram envelope stuffing apparatus of the above type has been successfully employed for many years. Although working well, there is a limitation on the throughput at the insertion station because of the reciprocating action of the ram plate. Typically, the ram insertion station operates well at a rate less than 6000 cycles (or envelopes per hour) for #10 (4 inch by 9 inch) envelopes. The rate of operation varies for different sized envelopes.

improvements have been made recently in the throughput of the upstream modules of the inserter machine. An example of recent improvements is in the area of a dual accumulator described in U.S. patent application Ser. No. 519,199 filed May 4, 1990, also assigned to the assignee of the present invention. However, the insert station employing the ram plate cannot take advantage of the improvements to the throughput of the upstream modules. This is, in part, due to the physical constraints associated with the ram mechanism, and, in part, to the motion inherent in the operating ram. Attempts at increasing the throughput of the ram type insert station has resulted in severe vibrations as the mass of the ram reciprocates at higher speeds. Such vibrations induce severe life storage of the parts in the insert station. In addition, the reliability of the insert station decreases significantly at the higher speeds.

An improved envelope stuffing apparatus, or insert station, is described in U.S. patent application Ser. No. 7/608515, field Nov. 2, 1990. The improved insert station replaces the ram mechanism with pusher fingers and replaces typical envelope throat openers, or fingers, with throat openers with side guides. Although the improved insert station has worked well for envelopes of fixed size and style, problems have been encountered when the insert station was configured for a particular style of envelope, for example, side seam envelope, and another style of envelope, for example, executive style, is used. Specifically, the reliability of inserting collated documents deteriorates when the cut in the throat of the envelope being used differs from the cut in the throat of the envelope for which the insert station was initially configured.

SUMMARY OF THE INVENTION

It has been found that the farther the envelope throat was from the end of the center deck plate of the improved insert station, the more likely that the documents would crash into the bottom side of the envelope as the pusher fingers advance the documents for insertion into the envelope. It has been determined that this is a problem heretofore not encountered with the ram style insert station because the ram plate carried the material directly into the envelope.

It has been found that by making the center deck plate of the improved insert station adjustable, the insert station can be easily reconfigured to handle a variety of envelope styles and sizes. The present invention provides a means for moving the center deck plate such that the end of the deck plate is immediately adjacent to the throat of the envelope no matter which style or size of envelope is used.

It has also been found that raising the height of the center deck plate to at least the same height as the horizontal members of the throat openers further improves the reliability of that the documents will be successfully inserted into the envelope.

In an envelope stuffing apparatus having an enclosure inserting station and including a deck at the inserting station, side guides coupled to the deck, means for delivering an enclosure along the deck, means for feeding the envelope to the deck, means for opening the envelope, and means for inserting an enclosure into the envelope and for removing the envelope from the inserting station and wherein said opening means includes means for supporting the flap of the envelope above the deck, there is an improvement in the inserting means for handling different style envelopes. The improvement comprises an adjustable section of the deck comprising at least a center line section of the deck wherein the adjustable section is positionable so as to be adjacent to a specified throat opening of the envelope. The adjustable section of the deck comprises a center deck plate adjustable in upstream and downstream directions. The deck plate is on a horizontal plane slightly higher than a plane of horizontal members of a pair of throat openers.

BRIEF DESCRIPTION OF THE DRAWINGS

As shown in the drawings, wherein like reference numerals designate like or corresponding parts through the several views.

DETAILED DESCRIPTION OF THE PREFERRED EMBODIMENT

Figure 1:
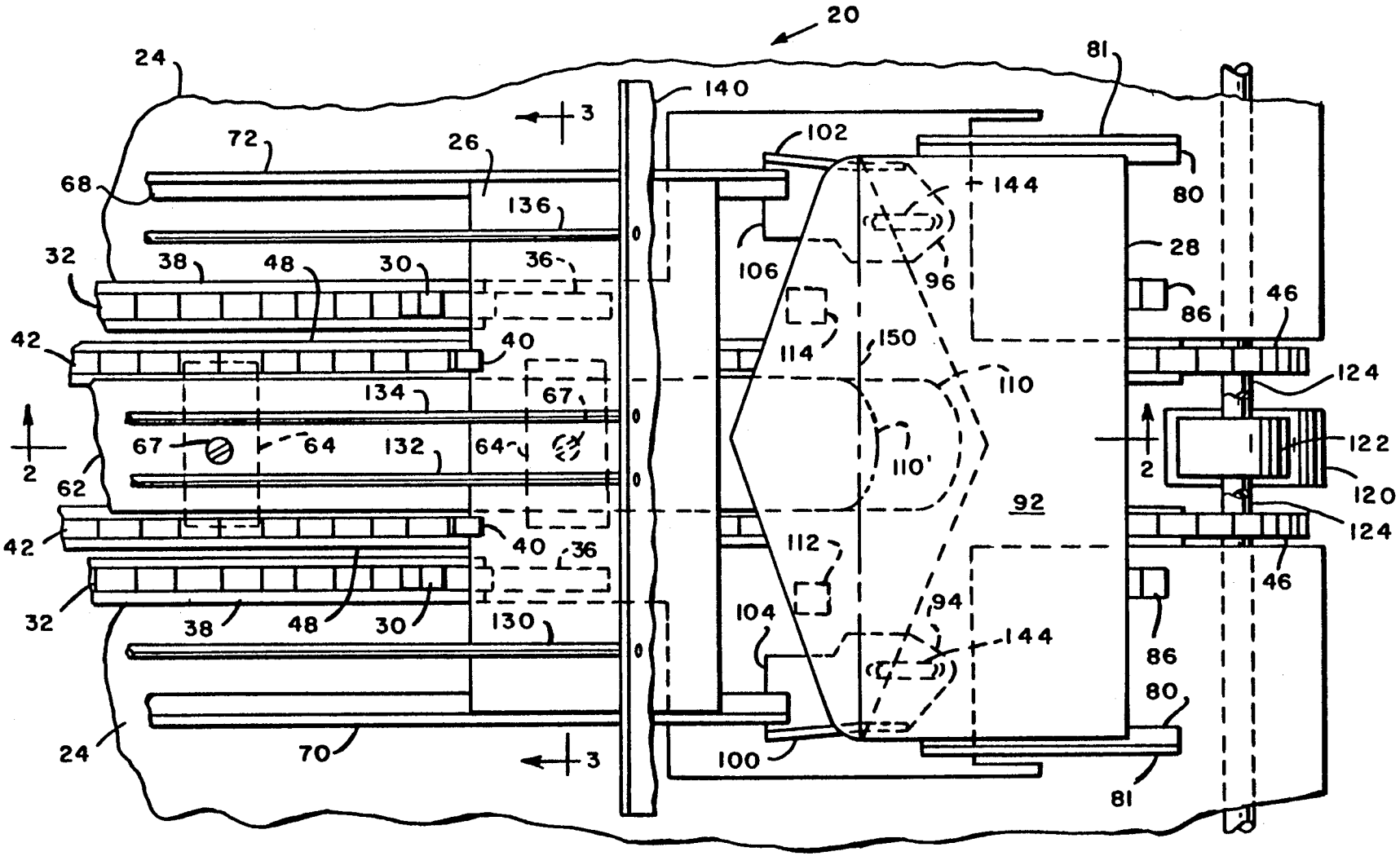
FIG. 1 is a top plan view of an envelope stuffing apparatus including the adjustable center deck plate in accordance with the present invention.
Figure 2:
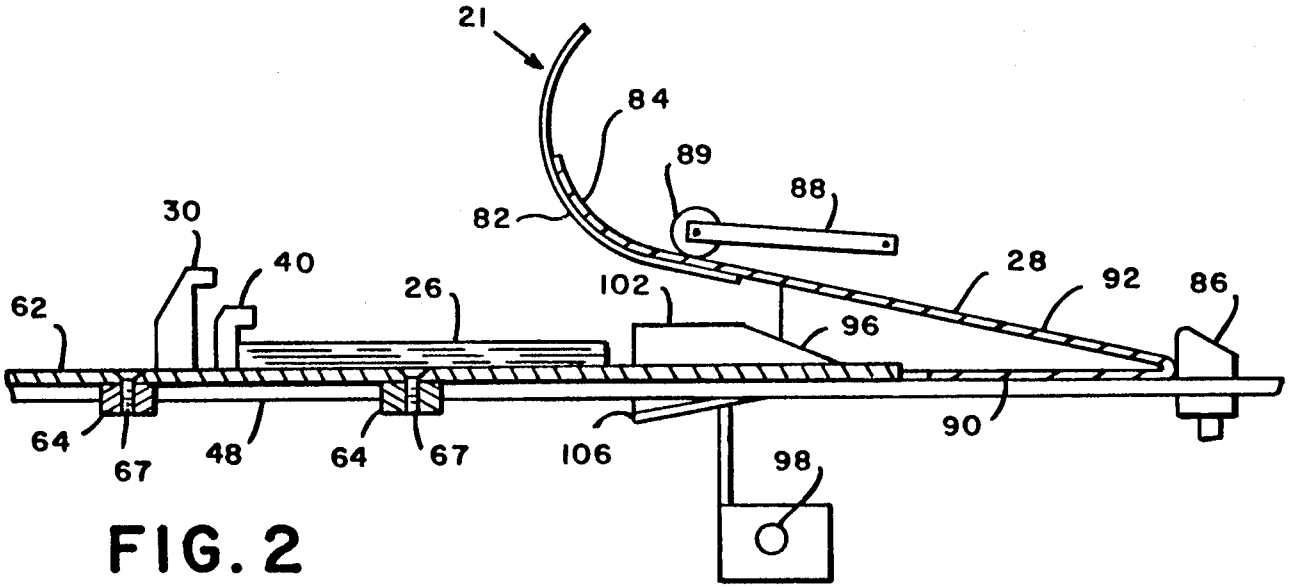
FIG. 2 is a side elevational view of the apparatus seen in FIG. 1, taken along the line 2—2 with other parts of the insert station not shown for the sake of clarity.
Figure 3:
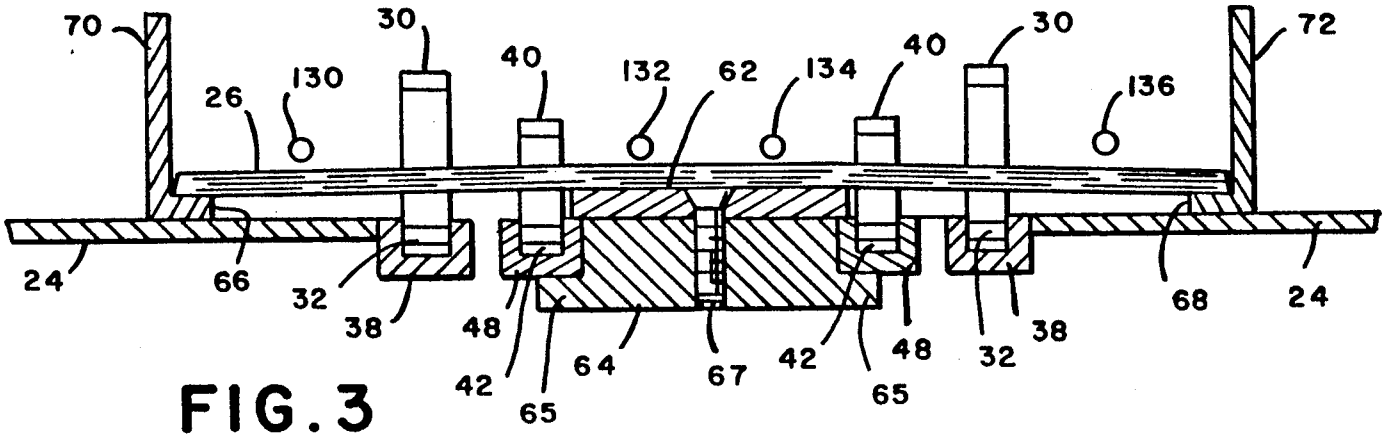
FIG. 3 is a front elevational view of the apparatus seen in FIG. 1, taken along the line 3—3.

In describing the preferred embodiment of the present invention, reference is made to the drawings wherein there is seen in FIGS. 1, 2 and 3, the improved insert station described in U.S. patent application Ser. No. 7/608515, filed Nov. 2, 1990, which is assigned to the assignee of the present invention and incorporated herein by reference, including the improvement to the center deck plate in accordance with the present invention.

The insert station 20, which is part of a conventional inserting machine (not shown), comprises an envelope feeder 21 (shown only in part) and an envelope stuffing apparatus. The envelope stuffing apparatus comprises conventional framework 22 for supporting various components of the apparatus 20 including a deck support 24.

There are two pairs of pushers, each pair operating in parallel for delivering enclosure 26 to envelope 28. Each of the larger pair of pushers 30 is attached to one of a pair of endless chain drives 32 which are mounted on pairs of sprockets 34 and 36. Sprockets 34 are located upstream of the envelope stuffing apparatus. Sprockets 36 are located adjacent the insert area. The upper reach of each chain 32 is housed in a channel 38 for positioning and stabilizing the movement of pushers 30. In operation, pushers 30 transport documents 26 from upstream feed stations of the inserter machine to the insert station 20 at a suitable speed, depending on the speed of the machine. For example, at 7200 cycles, the pushers 30 are moving 54 inches per second.

Downstream from the last enclosure feeder 6 of the inserting machine, a smaller pair of pushers 40 are each fixed to one of a pair of endless chain drives 42 each of which chain drives is mounted on sprockets 44 and 46. Sprockets 46 are the drive sprockets which are driven at a speed whereby pushers 40 have a linear speed, for example, of approximately one and one half (1.5) the linear speed of pushers 30. The upper reach of chains 42 are housed in channels 48 for positioning and stabilizing the movement of pushers 40.

Sprockets 44 are positioned adjacent the last enclosure feed 6 and the change in deck level 16 at 50. Beginning at the deck level change 50, the documents are transported on a insert station deck 60 consisting of center deck plate 62, and the bottom members 66 and 68 of side guides 70 and 72.

The distance between longitudinally spaced pushers 40 on each chain drive 42 is a function of the distance between every two longitudinally spaced pushers 30 on chain driver 32 and the speed differential desired comparing the speed of pushers 40 to the speed of pushers 30. For example, if the distance between longitudinally spaced pushers 30 is 27 inches, for a desired speed differential of approximately 1.5, the distance between longitudinally spaced pushers 40 is 42 inches (or approximately 1.5 times 27 inches). There are two pushers 40 on each of chain drives 42. In operation, the pushers 40 overtake pushers 30 in the delivery of the documents to the insert station shortly after pushers 30 transport the documents past deck level change 50. It will be understood by those skilled in the art that any suitable drive mechanism for pushers, for example, a belt drive, could also be used to drive pushers 40.

The arrangement of pushers 40 and chain 42 provides means for speeding up the insert process. This arrangement is an improvement over enclosure ram means such as described in U.S. Pat. No. 4,337,609 issued to Dean H. Foster, at al. in Jul. 6, 1982 and assigned to the assignee of the present invention. In such ram insert arrangements the ram plate typically includes a means for gripping the inserts whereby the registration and alignment of the inserts are maintained until the ram means is withdrawn from the envelope well after the enclosure insertion has been completed.

There is an envelope feeder 21 (shown in part) for feeding envelopes 28 to envelope deck 80. Deck 80 comprises two adjustable side guides 81, each with a bottom member operating as deck 80. An example of an envelope feeder which can be used in conjunction with the present invention is described in U.S. Pat. No. 4,775,140 issued to Dean H. Foster on Oct. 4, 1988 and assigned to the assignee of the present invention. There is ledge 82 on which the envelope flap 84 is supported during insertion of the documents. As the envelope is fed, a pair of stops 86 are used to stop and register the envelope 28. There are at least two depressor fingers 88, each including a roller 89, which apply pressure to envelope flat 84 during the insertion of the documents. Depressor fingers 88 provide stability of the envelope during the throat opening and insertion of documents. When envelope 28 is fed, depressor fingers 88 pivot from a raised position to engage the envelope flap 84.

There are a pair of throat openers 94 and 96 which open the envelope by separating the bottom side 90 of envelope 28 from the upper side 92. The throat openers 94 and 96, shown in a raised position in FIG. 2, pivot about point 98 from a retracted position below the deck to the raised position whereby the throat openers 94 and 96 become a continuation of deck 60 for guiding the documents into envelope 28. The throat openers 94 and 96 include side guide members 100 and 102 respectively which act as continuation of side guides 70 and 72. Side guide members 100 and 102 prevent any skewing of the documents or crashing of the documents into the side edges of envelope 28.

The downstream end of side guides 70 and 72 overlap, respectively, with the upstream portion of throat openers 94 and 96 which are downwardly angled at 104 and 106 so that side guide 70 ends above the angled portion 104 and side guide 72 ends above angled portion 106. In this manner, throat openers 94 and 96 perform the dual task of opening envelope 28 and continuing the side guide into the envelope.

Throat openers 94 and 96 replace the typical fingers used for opening envelopes at an insert station. In addition to opening envelope 28, throat openers 94 and 96 act as side guides for the collation 26 and also act as ramps for avoiding a collision between the collation 26 and the side edges of envelope 28.

The movement of stops 86, depressor fingers 88 and throat openers 94 and 96 is controlled respectively by three conventional cams on a shaft (not shown) under deck support 24. The cams are suitable for sequentially raising stops 86, lowering fingers 88 and raising throat openers 94 and 96 as envelope 28 is fed.

In accordance with the present invention, center deck plate 62 is adjustably mounted on the top of the inner rails of channels 48. Deck plate 62 is secured to at least two adjustable mounting blocks 64 by screws 67. Blocks 64 include a generally rectangular portion which closely fits between channels 48, and two leg members 65 which engage the bottom sides of channels 48. When screws 67 are tightened, deck plate 62 is securely clamped to channels 48. To adjust center deck plate 62 for a particular envelope, screws 67 are loosened and the coupled deck plate 62 and blocks 46 are slid to a position such that the end of deck plate 62 is just short of the center section of the throat of an envelope at the insert location without interfering with the opening of the envelope by throat openers 94 and 96. In this manner, deck plate 62 can be adjusted to match the throat opening of any envelope fed by envelope feeder 21.

Figure 4:
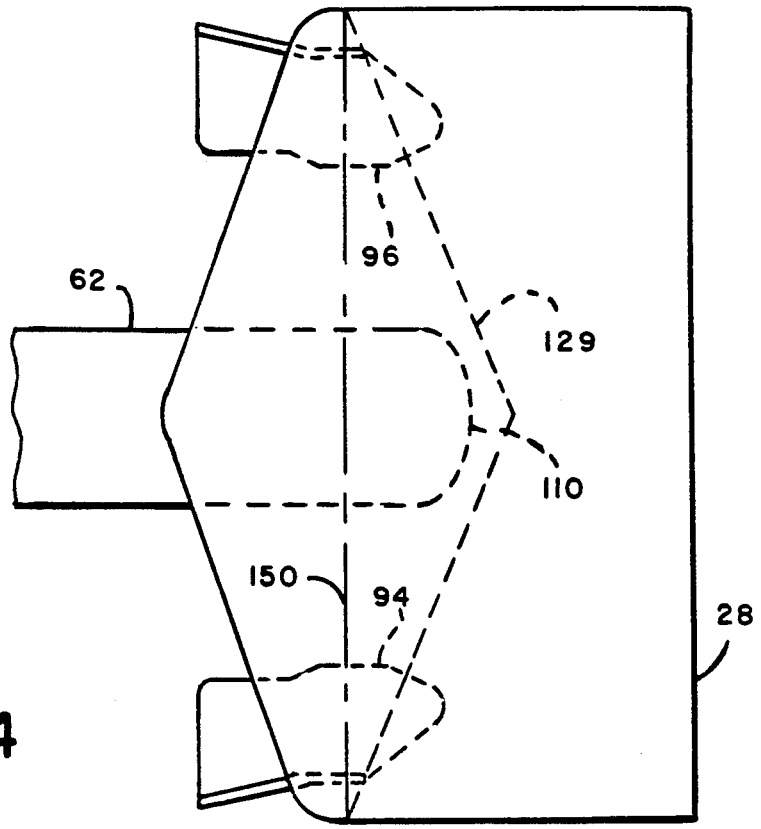
FIG. 4 is a plan view of the center deck plate adjusted to handle executive style envelopes.
Figure 5:
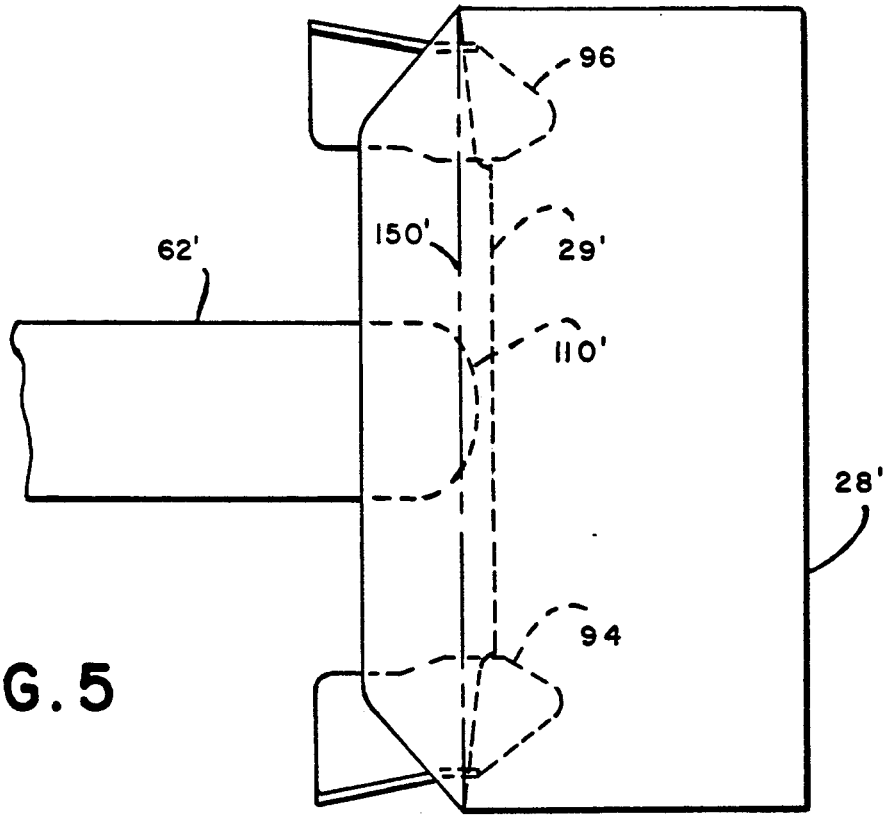
FIG. 5 is a plan view of the center deck plate adjusted to handle side seam style envelopes.

It has been found that adjusting deck plate 62 to match the location of the center cut of the envelope throat, provides insert station 20 with the flexibility of handling a wide variety of envelope styles and sizes. In FIGS. 1 and 4, deck plate 62 is shown in position 110 to insert into envelope 28 which is an executive style envelope. In FIG. 5, deck plate 62 is shown in a position 110' to insert into envelop 28' which is a side seam style envelope. It can be seen in FIGS. 1, 4 and 5 that the fold lines 150 and 150' remain at a fixed location regardless which style of envelope is used. The location of the fold line also remains fixed for any size envelope. Stops 86 can be adjustably positioned to maintain a fixed fold line location.

In U.S. application Ser. No. 7/608515, filed Nov. 2, 1990, the downstream end or "lip" of the center deck plate was slightly angled upwardly at its downstream end. This arrangement was intended to urge the center section of the documents in an upward direction to ensure that the center of the documents did not crash into the bottom side of the envelope. It has been found that this arrangement is not adequate to ensure the completion of an insertion when the envelope throat is not immediately adjacent to the lip of the center deck plate.

With adjustable deck plate 62, it has been found that is not necessary to urge the center section of documents 26 in an upward direction to prevent the documents from crashing into the bottom side 90 of envelope 28. In the preferred embodiment of the present invention, deck plate 62 has an appropriate thickness which puts deck plate 62 on the a plane slightly higher than the horizontal members of the throat openers 94 and 96. As documents 26 are about to be inserted into envelope 28, the outside edges of the documents, which are being transported on the bottom members 66 and 68 of side guides 70 and 72, are pushed onto throat openers 94 and 96, and the center section of the documents is conveyed on center deck plate 62, thus ensuring that the center section of documents 26 is above bottom side 90 of envelope 28. Since center deck plate 62 is immediately adjacent to the center cut of the envelope throat, and since the top of deck plate 62 is a slightly higher than the horizontal members of throat openers 94 and 96, the center section remains above the bottom side 90 of envelope 28. This arrangement ensures that the documents do not hit the bottom side 90 of envelope 28.

In the event the collation of documents 28 includes a less than full width document on the bottom, i.e., one that does not reach the bottom members 66 and 68 of side guides 70 and 72, then ramp members 112 and 114 are provided to prevent such smaller items in the collation from crashing into the bottom edge 90 of envelope 28. The top of ramp members 112 and 114 are angled less than 60 degrees upwardly in the downstream direction to raise the ends of such documents so that they miss the bottom side 90 of envelope 28.

There are a pair of takeaway rollers downstream from insert station. Driven roller 120 is mounted on drive shaft 124 on which is also mounted sprockets 46. Spring-loaded idler roller 122 operates in cooperation with driven roller 120 to yank the envelope 28 rom pushers 40 before pushers 40 begin to follow the perimeter of sprockets 46. Roller 120 has a diameter larger than sprockets 46 such that the linear speed of the envelope in the grasp of rollers 120 and 122 is faster than the linear speed of pushers 40.

The speed differential between pushers 30 and 40 may cause documents 26 to rise off the deck as pushers 40 take over the advancement of documents 26. There are guide bars 130, 132, 134 and 136 which act to insure that the documents remain below the upper member lip of each pusher 40. The guide bars also act in conjunction with ledge 140 to ensure suitable clearance as the top of the enclosure stack enters the envelope 28. Guide bars 130, 132, 134 and 136 are suitably mounted upstream in a frame member (not shown) and downstream to ledge 140. Ledges 140 and 82 include two slot openings corresponding to the path of pushers 40 to ensure ledges 140 and 82 do not interfere with pushers 40.

There is a sensor switch 144 associated with each throat opener. The sensors operate to detect when an envelope is not present or has not been opened for insertion. There is a slot in each of throat openers 94 and 96 through which the hook in the respective sensor 144 fits through when an envelope has not been fed or has not been opened.

Side guides 70, 72 and 81, depressor fingers 88 and throat openers 94 and 96 can be laterally positioned to handle different sized documents and envelopes. It will be appreciated by those skilled in the art that adjustable center plate 62, now provides an improvement that ensures improved reliability in the handling of different sized documents and envelopes as well as different styled envelopes.

It will be appreciated by those skilled in the art that there has now been described an improved envelope stuffing apparatus with an adjustable deck. Although the present invention has been described in conjunction with a specific embodiment thereof, many alternatives, modifications and variations will be apparent to those skilled in the art. Accordingly, it is intended for the present invention to embrace all such alternatives, modifications and variations that follow within the spirit and scope of the appended claims.

What is claimed is:

1. In an envelope stuffing apparatus having an enclosure inserting station and including a deck at the inserting station, side guides coupled to the deck, means for delivering an enclosure along the deck, means for feeding an envelope to the inserting station, means for opening the envelope, means for inserting the enclosure into the envelope and means for removing the envelope from the inserting station, and wherein said opening means includes means for supporting the flap of the envelope above the deck and a pair of throat openers each having a horizontal member, and wherein the improvement further comprises, an improvement in the inserting means for handling different style envelopes, said improvement comprising:

an adjustable section of the deck comprising at least a center line section of the deck wherein said adjustable section is positionable so as to be adjacent to a specific throat opening of the envelope.

2. The improvement according to claim 1 wherein said adjustable section of said deck comprises a center deck plate adjustable in an upstream and downstream direction.

3. The improvement according to claim 2 wherein said center deck plate is on a horizontal plane slightly higher than a plane of the horizontal members of said throat openers.

4. The improvement according to claim 3 wherein the improvement further comprises means for adjustably securing said center deck plate to a pair of channel members extending parallel to the deck.

5. The improvement according to claim 4 wherein said securing means comprises at at least two mounting blocks adjustably situated between said channel members, said center deck plate being clamped to said channel members when said center deck plate is secured to said mounting blocks.

6. In an envelope stuffing apparatus having an enclosure inserting station and including a deck at the inserting station, side guides coupled to the deck, means for delivering an enclosure along the deck, means for feeding an envelope to the inserting station, means for opening the envelope, means for inserting an enclosure into the envelope, and means for removing the envelope from the inserting station, and wherein said opening means includes two throat openers each having a horizontal member, and wherein said inserting means includes pusher means for advancing the enclosure towards the inserting station and for inserting the enclosure into the envelope, an improvement in the inserting means, said improvement comprising:

an adjustable section of the deck comprising at least a center line section of the deck wherein said adjustable section is positionable so as to be adjacent to a specific throat opening of the envelope.

7. The improvement according to claim 6 wherein said adjustable section of said deck comprises a center deck plate adjustable in an upstream and downstream direction.

8. The improvement according to claim 7 wherein said center deck plate is on a horizontal plane slightly higher than a plane of the horizontal members of said throat openers.

9. The improvement according to claim 8 wherein the improvement further comprises means for adjustably securing said center deck plate to a pair of channel members extending parallel to the deck.

10. The improvement according to claim 9 wherein said securing means comprise at least two mounting blocks adjustably situated between said channel members, said center deck plate being clamped to said channel members when said center deck plate is secured to said mounting blocks.

11. In an envelope stuffing apparatus having an enclosure inserting station and including a deck at the inserting station, side guides coupled to the deck, means for delivering an enclosure along the deck, means for feeding an envelope to the inserting station, means for opening the envelope, means for inserting the enclosure into the envelope and means for removing the envelope from the inserting station, and wherein said opening means includes means for supporting the flap of the envelope above the deck and a pair of throat openers having horizontal members for stripping apart form each other the front and back panels of the envelope, and wherein said inserting means includes a pair of first pushers driven by first drive means at a first speed for advancing the enclosure towards the insert station and a pair of second pushers driven by a second drive means at a second speed for overtaking the first pushers and advancing the enclosure to the insert station, said second speed being greater than the first speed, said second pushers being further operable for inserting the enclosure into the envelope, said second drive means including a pair of channel members situated parallel to the deck, an improvement in the inserting means, said improvement comprising:

an adjustable section of the deck including a center deck plate and means for securing said center deck plate to said channel members wherein said center deck plate can be adjustably positioned along said channel members whereby said center deck plate is adjacent to a specific throat opening of the envelope.

12. The improvement according to claim 11 wherein said center deck plate is on a horizontal plane slightly higher than a plane of the horizontal members of the throat openers.

13. The improvement according to claim 11 wherein said securing means comprises at least two mounting blocks adjustably situated between said channel members, said center deck plate being clamped to said channel members when said center deck plate is secured to said mounting blocks.

* * * * *